United States Patent [19]

Pruess et al.

[11] Patent Number: 4,946,609

[45] Date of Patent: Aug. 7, 1990

[54] ENGINE LUBRICATING OIL FOR DIESEL ENGINES AND PROCESS FOR OPERATING A DIESEL ENGINE

[75] Inventors: August-Wilhelm Pruess, Dorsten; Dieter Hoehr, Wessel; Kurt-Peter Schug, Dorsten; Hansjuergen Guttman, Schermbeck, all of Fed. Rep. of Germany

[73] Assignee: Veba Oel Aktiengesellschaft, Gelsenkirchen, Fed. Rep. of Germany

[21] Appl. No.: 325,998

[22] Filed: Mar. 20, 1988

[30] Foreign Application Priority Data

Mar. 19, 1988 [DE] Fed. Rep. of Germany ..... 3309307

[51] Int. Cl.[5] ..... C10M 139/06

[52] U.S. Cl. ..... 252/35; 252/42.7; 252/49.7

[58] Field of Search ..... 252/35, 42.7, 49.7, 252/37, 37.2

[56] References Cited

U.S. PATENT DOCUMENTS

| | | | |
|---|---|---|---|
| 3,178,367 | 4/1965 | Dubin et al. | 252/35 |
| 4,162,986 | 7/1979 | Alkaitis et al. | 252/35 |
| 4,198,305 | 4/1980 | Okorodudu | 252/48.6 |
| 4,483,777 | 11/1984 | Shim | 252/49.5 |
| 4,501,677 | 2/1985 | Habeeb | 252/37 |

FOREIGN PATENT DOCUMENTS

| | | |
|---|---|---|
| 052478 | 5/1982 | European Pat. Off. . |
| 211233 | 2/1987 | European Pat. Off. . |
| 961916 | 4/1957 | Fed. Rep. of Germany . |
| 2826147 | 12/1978 | Fed. Rep. of Germany . |
| 334248 | 9/1989 | Fed. Rep. of Germany . |
| 599464 | 11/1977 | Switzerland . |
| 902610 | 7/1960 | United Kingdom . |

OTHER PUBLICATIONS

6001 Chemical Abstracts 102(1985), Feb., No. 6, Columbus, OH, U.S.A., pp. 149–150, vol. 102, 51–Fossil Fuels.

*Primary Examiner*—Jacqueline V. Howard
*Attorney, Agent, or Firm*—Oblon, Spivak, McClelland, Maier & Neustadt

[57] ABSTRACT

To avoid an unacceptably high exhaust gas back pressure when operating diesel engines equipped with a particle filter in the exhaust gas stream, an engine lubricating oil is used that has a catalytically active content of an iron compound in an amount of 5 to 20,000 ppm. The use of the additive facilitates the regeneration of the diesel particle filters by burning, especially under operating conditions of the diesel engine that lead only to relatively low exhaust gas temperatures. Iron compounds proposed are ferrocene, ferrocene derivatives, and iron salts of organic acids.

15 Claims, 2 Drawing Sheets

ENGINE LUBRICATING OIL FOR DIESEL ENGINES AND PROCESS FOR OPERATING A DIESEL ENGINE

BACKGROUND OF THE INVENTION

1. Field of the Invention

This invention concerns an engine lubricating oil for diesel engines equipped with a particle filter in the exhaust gas stream and a process for operating a diesel engine with a particle filter system following the engine in the exhaust pipe, in which the temperature for the burning of particles deposited in the filter system is lowered because of the presence of catalytically active iron compounds.

2. Discussion of the Background

The emission of soot particles in the exhaust gas of diesel engines caused by their operation has already been subjected to more or less severe restrictions by legislation in various countries. The purpose of these restrictions is the most complete possible prevention of the emission into the atmosphere of particles containing soot, polycyclic compounds, and other substances generated from the operation of diesel engines.

For this reason, effective diesel particle filter systems have been developed by engineers, with so-called monolithic ceramic filters, with honeycomb structure ceramic bodies that contain channels sealed at alternate ends being used or ceramic spiral filters made of perforated steel support tubes arranged circularly with several layers of a roughened yarn of ceramic fibers (See ATV 1/2/88, pages 14 to 17).

The exhaust gas from the diesel engines flows through the labyrinthine passages of the monolithic ceramic filters, with the ceramic walls forming the honeycomb passageways in turn being porous and permitting the passage of the exhaust gas relieved of particles, or if flowing through the so-called spiral filter, with the exhaust gas particles being retained by the filaments of the ceramic yarn.

There is a corresponding pressure drop with increasing loading of these filter systems installed in the exhaust pipe downstream from the engine, which leads to an efficiency loss of the diesel engine. A pressure buildup in the exhaust gas system has to be avoided by continuous or periodic regeneration of the filter systems.

European Patent EP-No. 0 052 478-Bl discloses a method of operating a diesel engine in which a diesel fuel is burned in the engine, and then the engine exhaust gases are fed through a separator by which soot particles are removed from the gases. The separator is heated to a temperature high enough to bring about oxidation of the soot particles. Particles of a catalyst which lowers the oxidation temperature of the soot are introduced into the separator with the exhaust gases. Suitable catalyst substances are stated to be lead, copper, manganese, or mixtures of these, in elemental form or preferably in the form of chemical compounds, with the catalyst substances preferably being added to the diesel fuel.

SUMMARY OF THE INVENTION

One object of the present invention is a new engine lubricating oil for diesel engines, and a method for economical, efficient and clean operation of a diesel engine, with a particle filter system in the exhaust line following the engine, using this oil.

These and other objects which will become apparent in the course of the following specification have been achieved by the present engine lubricating oil for diesel engines equipped with a particulate filter in the exhaust gas stream, which comprises an engine oil and 5–20,000 ppm, based on the engine oil, of an iron compound, wherein the iron compound is capable of catalyzing the oxidative regeneration of and burning of soot particles from the particulate filter.

The invention is also directed to a process of operating a diesel engine using the engine oil of the present invention. In the present process, soot particles deposited in the particulate filter are catalytically burned off due to the presence of the iron compound.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
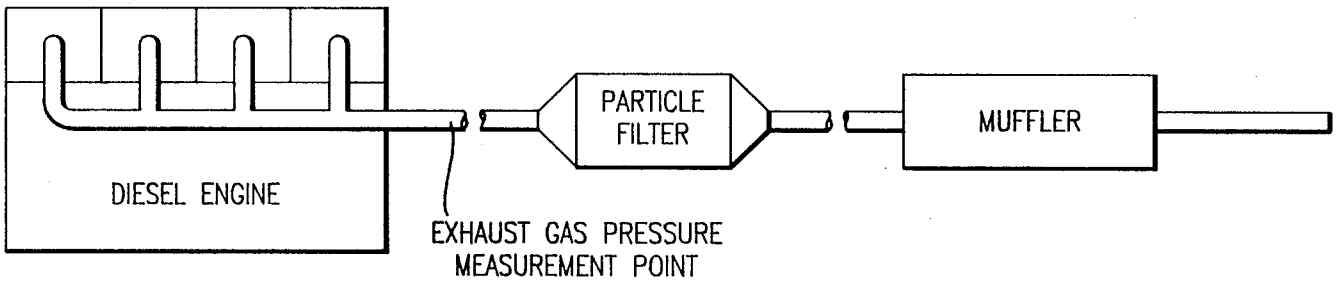
FIG. 1 shows schematically the test setup used for the installation of the diesel particle filter in the exhaust gas line of the diesel engine and the point of pressure measurement.
Figure 2:
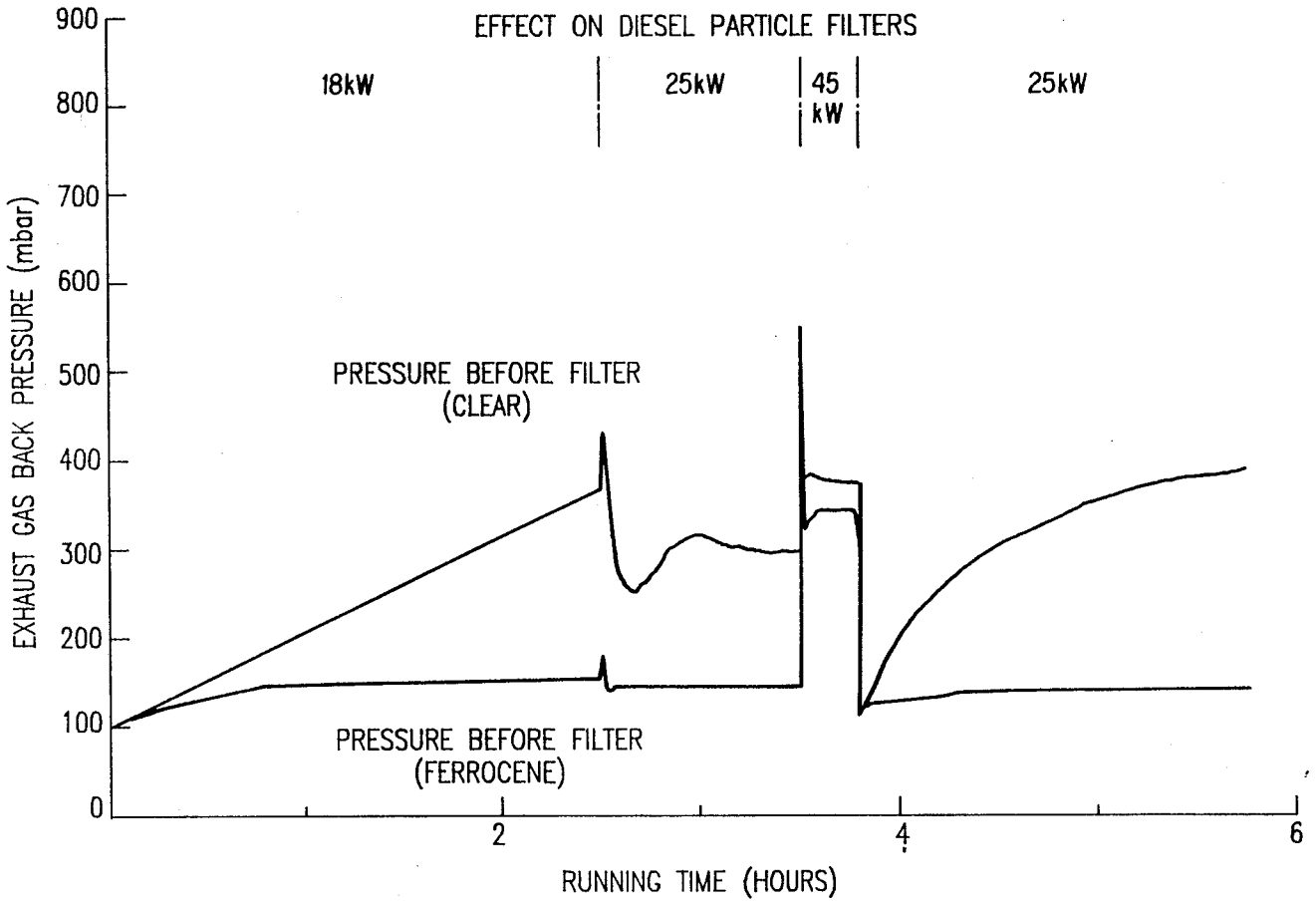
FIG. 2 graphically shows, in a diagram, the experimental results obtained with the lubricating oil containing an iron additive, compared to the use of the lubricating oil without additive.

The temperatures adequate for regeneration of the diesel particle filters by oxidative burning should be low enough for regeneration to occur as frequently as possible. Under unfavorable operating conditions for the diesel engine, i.e., a low power output which leads to only low exhaust gas temperatures, the filter becomes so loaded with particles that the exhaust gas back pressure reaches unacceptably high values. In addition, there is the danger that a filter that is too heavily loaded with be too severely thermally stressed by burning during oxidative regeneration and will melt locally, which can lead to impairment in the operation of the filter.

Preferably, the particle filter should allow the smooth and regular burning of soot from the filter under a variety of diesel engine operating conditions.

This invention, then, is directed to an engine lubricating oil for use in diesel engines equipped with a particle filter system, where the oil contains a catalytically active amount of an iron compound capable of catalyzing the oxidative regeneration of the particulate filter in the exhaust stream. It is surprising that the iron compounds added to the engine oil alone are capable of and efficient at catalyzing the regeneration of the particulate filter in the exhaust stream.

The invention is based on the knowledge that a certain fraction of the lubricating oil also participates in the engine combustion. Since the iron additive is present in the lubricating oil of the invention, the catalytically active iron substance is also supplied in adequate amounts to the diesel particle filter system with the hot engine exhaust gas during the proper operation of the engine. The particulate organic constituents (soot particles) held back by the filter undergo further reaction which substantially regenerates the particulate filter.

Naturally, the objects of the invention are also assisted by the catalytically favored reaction of the particulate organic constituents with the residual oxygen in the exhaust gas, which occurs even before they are deposited on the filter. It is possible pursuant to the invention, by the use of an iron additive to the lubricating oil, to maintain a content of catalytically active iron compounds in the exhaust gas stream which is sufficient for the regeneration of the diesel particle filter. Ratios by weight of 5 to 20,000, preferably 50 to 10,000 ppm of the iron compound, especially of an organometallic iron compound, based on the amount of lubricating oil are preferred.

Ferrocene, i.e., bis($\pi$-cyclopentadienyliron), alkylated ferrocenes, bis-ferrocenes and complex salts of iron compounds with an organic acid in which the ratio of the number of equivalents of the organic acid to the number of iron atoms has a value of 3 or less are preferred. Suitable alklyated ferrocenes include ferrocenes containing one or more alkyl groups on each of the cyclopentadiene rings. Preferred alkylated ferrocenes contain a single $C_{1-6}$ alkyl group on each cyclopentadiene ring. Preferred specific examples include ethyl ferrocene and butyl ferrocene. Bisferrocenes containing two ferrocene radicals may also be used as the catalytic iron compound. A suitable bis-ferrocene is, for example, 2,2-bis(ethyl ferrocenyl) propane.

Preferred organic acid-iron complex salts include iron salts of aromatic carboxylic acids as well as aliphatic carboxylic acids. Preferred iron salts of aromatic carboxylic acids include iron salts of aromatic carboxylic acids having one or two aromatic rings, such as iron (III) benzoate and iron (III) naphthenate. Preferred iron salts of aliphatic carboxylic acids are iron salts of aliphatic carboxylic acids having up to 10 carbon atoms, for example, iron (III) octanoate. Iron (III) tallate, that is, the ferric salt of tall oil is also preferred. The aforementioned compounds are especially suitable as additives because of their catalytic efficacy and their good solubility and lubricating oil compatibility.

Diesel fuels which may be used in the method of the present invention include all conventionally used diesel fuels including diesel fuels containing additives for low temperature operation. Suitable diesel fuels include grades 1D, 2D and 4D. Diesel fuels which may be used in the process of the present invention are described, for example, in Kirk-Othmer, Encyclopedia of Chemical Technology, vol. 11, pages 682–689.

Suitable lubricating oils to which the iron additives of the present invention are incorporated, include all conventional lubricating oils for use with diesel engines. Suitable lubricating oils include both single weight oils, for example, 20W, 30W, 40W and 50W grade oils as well as variable viscosity oils meeting the requirements of more than one grade, such as for example, 15W-40 and 10W-30 grade oils. Viscosity grading of the oils indicated above is by conventional SAE classification.

The present method of operating a diesel engine can be performed with any conventionally available diesel fuel engine equipped with a particulate filter system in the exhaust gas stream. The method is suitable for automobile and truck diesel operation as well as for marine diesel engine operation.

The proposed use of an additive with the lubricating oil provides a beneficial alternative to introducing the catalytically active compounds by adding them to the diesel fuel or adding the active compounds by means of a separate additional metering device.

The additive of the present invention may be added to the engine lubricating oil of the invention by direction solution, for example, up to a concentration of 20,000 ppm in the oil, or by making concentrated solutions in a suitable lubricating oil component and adding the concentrated solution to the oil. Use of the additives in concentrations of 5 to 20,000 ppm is preferred, and especially 50 to 10,000 ppm, based on the engine lubricating oil (ratio by weight).

It is possible by using the lubricating oils with additives pursuant to the invention, to operate economically with a diesel engine conforming to US Standard FTP 75 equipped with a diesel particle filter system, based on a reasonable lifetime of the filter system.

It can be shown that the ash-forming particles introduced additionally in the exhaust gas stream upstream from the filter are retained by the filter to a great extent and lead only to a negligible deterioration of the filter flow resistance.

Other features of the invention will become apparent in the course of the following descriptions of exemplary embodiments which are given for illustration of the invention and are not intended to be limiting thereof.

EXAMPLES

Comparison Example

Oil without Iron Additives:

The effect pursuant to the invention has been verified in a comparison test program with a Ford 2.5 liter direct injection engine in stationary operation. The engine was equipped with a diesel particle filter system consisting of a ceramic monolithic filter system, manufactured by Corning, installed in the exhaust stream line downstream from the engine. Obviously, the present invention is not limited to this type of particle filter, but may be practiced with any conventionally available particle filter. The engine was operated with a commercial 15W-40 weight commercial diesel engine lubricating oil. With a constant power output of 18 kW, an exhaust stream back pressure rising from 100 mbar to about 350 mbar built up over a running time of 2.5 hours.

Following an increase in the power load from 18 to 25 kW, the back pressure was decreased to a value somewhat below 250 mbar by partial burning of the ceramic filter coating because of higher exhaust gas temperatures. The back pressure rose to about 300 mbar within a period of half an hour, and then remained at a plateau somewhat below 300 mbar for the rest of the test time with this power load. An operating state with a power load of 45 kW was used to burn the filter clear. A decrease in the exhaust stream back pressure to 100 mbar was in fact reached by the burnoff; however, when the power output was throttled back to the prior operating state of 25 kW, a steady rise of the exhaust stream back pressure was observed, which approached a value of about 400 mbar asymptotically. This exhaust stream back pressure produces a drastic impairment of the engine efficiency.

Example

Oil Containing Iron Additive

Operating under otherwise identical conditions and with a time schedule analogous to that used in the comparative example described above, using a 15W-40 weight lubricating oil with 8,400 ppm of ferrocene as an additive, an initial power load of 18 kW and an exhaust stream back pressure of 100 mbar, a slight buildup to a pressure of about 150 mbar was observed, which then remained constant at a level of about 150 mbar. No substantial change of this plateau was observed when the the power output was increased to 25 kW.

To reach conditions that guarantee that the carbonaceous particles deposited on the filter are largely burned off, a state of full-load engine operation was used with a power output of 45 kW. With such an increase of the power output, which occurs only briefly under actual engine operating conditions, the exhaust gas pressure rose to 350 mbar and remained at this level with a somewhat declining trend. When the power output was reduced to 25 kW, a stable level was reached at about 150 mbar, which was still below the level of the prior operating state with a power output of 18 kW. These values are only insignificantly above those of an unloaded filter and guarantee acceptable engine operating conditions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An engine lubricating oil for diesel engines equipped with a particulate filter in the exhaust gas system, consisting essentially of a diesel engine lubricating oil and 5–20,000 ppm, based on said engine lubricating oil, of an iron compound selected from the group consisting of ferrocene, an alkylated ferrocene, a bis-ferrocene and a complex salt of an organic acid and iron, in which the ratio of the number of equivalents of the organic acid to the number of iron atoms has a value of 3 or less, wherein said iron compound catalyzes the oxidative regeneration of said particulate filter.

2. The engine lubricating oil of claim 1, wherein said iron compound is present in an amount of 50–10,000 ppm based on said engine oil.

3. The engine lubricating oil of claim 1, wherein said iron compound is an iron (III) aromatic carboxylic acid or iron (III) aliphatic carboxylic acid complex salt.

4. The engine lubricating oil of claim 3, wherein said aromatic carboxylic acid has one or two aromatic rings.

5. The engine lubricating oil of claim 3, wherein said aliphatic carboxylic acid has up to 20 carbon atoms.

6. The engine lubricating oil of claim 1, wherein said iron compound is selected from the group consisting of ethyl ferrocene, butyl ferrocene and 2,2-bis(ethylferrocenyl) propane.

7. The engine lubricating oil of claim 1, wherein said iron compound is selected from the group consisting of iron (III) naphthanate and iron (III) octanoate.

8. The engine lubricating oil of claim 1, wherein said complex salt is a ferric salt of tall oil.

9. A process for operating a diesel engine with a particulate filter system in the exhaust line following the engine and for lowering the temperature for burning particles deposited in the filter system, consisting essentially of the step of:

operating said diesel engine with a lubricating oil containing 5–20,000 ppm, based on said lubricating oil, of an iron compound selected from the group consisting of ferrocene, an alkylated ferrocene, a bis-ferrocene and a complex salt of an organic acid and iron, in which the ratio of the number of equivalents of the organic acid to the number of ion atoms has a value of 3 or less, wherein said iron compound catalyzes the oxidative burning of particles deposited in said filter system during operation of said engine and lowers the temperature of oxidative burning of said particles in said filter.

10. The process of claim 9, wherein said lubricating oil contains 50–10,000 ppm of said iron compound.

11. The process of claim 9, wherein said iron compound is selected from the group consisting of ethyl ferrocene, butyl ferrocene and 2,2-bis(ethylferrocenyl) propane.

12. The process of claim 9, wherein said organic acid is an aromatic carboxylic acid having one or two aromatic rings.

13. The process of claim 9, wherein said organic acid is an aliphatic carboxylic acid having up to 20 carbon atoms.

14. The process of claim 9, wherein said iron compound is selected from the group consisting of iron (III) naphthanate and iron (III) octanoate.

15. The process of claim 9, wherein said complex salt is a ferric salt of tall oil.

* * * * *

UNITED STATES PATENT AND TRADEMARK OFFICE

CERTIFICATE OF CORRECTION

PATENT NO. : 4,946,609

DATED : AUGUST 7, 1990

INVENTOR(S) : AUGUST-WILHELM PREUSS ET AL.

It is certified that error appears in the above-identified patent and that said Letters Patent is hereby corrected as shown below:

ON TITLE PAGE: Item [22] please delete "March 20, 1988" and insert --March 20, 1989--.

Signed and Sealed this

Tenth Day of March, 1992

*Attest:*

HARRY F. MANBECK, JR.

*Attesting Officer*

*Commissioner of Patents and Trademarks*